US006608537B2

(12) United States Patent
Kanba et al.

(10) Patent No.: US 6,608,537 B2
(45) Date of Patent: Aug. 19, 2003

(54) BAND-PASS FILTER

(75) Inventors: Seiji Kanba, Kusatsu (JP); Naoki Mizoguchi, Shiga-ken (JP); Hisatake Okamura, Nagaokakyo (JP); Harufumi Mandai, Takatsuki (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/855,304

(22) Filed: May 15, 2001

(65) Prior Publication Data

US 2002/0030565 A1 Mar. 14, 2002

(30) Foreign Application Priority Data

May 23, 2000 (JP) ..... 2000-151759

(51) Int. Cl.[7] ..... H01D 1/203
(52) U.S. Cl. ..... 333/204; 333/219
(58) Field of Search ..... 333/204, 205, 333/219, 995

(56) References Cited

U.S. PATENT DOCUMENTS

| | | | | |
|---|---|---|---|---|
| 3,796,970 A | | 3/1974 | Snell, Jr. | |
| 5,172,084 A | * | 12/1992 | Fiedziuszko et al. | 333/204 |
| 5,786,303 A | * | 7/1998 | Mansour | 333/204 |
| 5,939,958 A | * | 8/1999 | Grounds et al. | 333/204 |

FOREIGN PATENT DOCUMENTS

| | | | |
|---|---|---|---|
| EP | 0 509 636 A1 | | 10/1992 |
| EP | 0 732 763 A1 | | 9/1996 |
| JP | 06-112701 | | 4/1994 |
| JP | 09-139612 | | 5/1997 |
| JP | 09-162610 | | 6/1997 |
| JP | 10284913 A | * | 10/1998 |
| SU | 1734143 A1 | * | 5/1992 |

OTHER PUBLICATIONS

Zhu et al, "A joint field/circuit design model of microstrip rign dual–mode filter: theory and experiments", 1997 Asia Pacific Microwave Conference, 1997, pp. 865–868.*

Hong et al, "recent Advances in microstrip filters for communications and other applications", 1997 The Institution of Electrical Engineers, 1997, pp. 1–6.*

Zun Fu Jiang Hejazi et al., "A new HTS microwave filter using dual–mode multi–zigzag microstrip loop resonators", Microwave Conference, 1999 Asia Pacific Singapore Nov. 30–Dec. 3, 1999, Piscataway, NJ, USA, IEEE, US, 11/19999, pp. 813–816, XP010374307, ISBN: 0–7803–5761–2.

* cited by examiner

*Primary Examiner*—Seungsook Ham
(74) *Attorney, Agent, or Firm*—Keating & Bennett, LL

(57) ABSTRACT

A band-pass filter includes a metal film provided on a dielectric body. The shape and size of the metal film and the coupling points of input-output coupling circuits are selected such that first and second resonance modes are generated. The metal film has protruding portions or concavities provided thereon such that resonance electric field strength in the first or second resonance mode is controlled to couple the first and second resonance modes to each other.

20 Claims, 17 Drawing Sheets

BAND-PASS FILTER

BACKGROUND OF THE INVENTION

1. Field of the Invention

The present invention relates to a band-pass filter, and more particularly to a band-pass filter for use, for example, in a communication device which operates in a range of from a microwave band to a millimeter wave band, for example.

2. Description of the Related Art

Conventionally, LC filters have been widely used as band-pass filters. FIG. 17 is an equivalent circuit diagram of a conventional LC filter.

The LC filter includes first and second resonators 101 and 102. The first and second resonators 101 and 102 each include a capacitor C and an inductor L, which are connected in parallel to each other. Moreover, to form the LC filter as a single electronic component, conventionally, a monolithic capacitor and a monolithic inductor are integrated with each other in a single body. That is, two resonators each including a monolithic capacitor portion and a monolithic inductor portion are provided to define a monolithic electronic component such that the circuit arrangement shown in FIG. 17 is produced. In this LC filter, the two resonators 101 and 102 are coupled to each other via a coupling capacitor C1.

When an LC filter having the circuit configuration shown in FIG. 17 is formed as a single component, many conductor patterns and via-hole electrodes for connecting the conductor patterns must be provided. Accordingly, these conductor patterns and via-hole electrodes must be very accurately formed.

Moreover, since many electronic component elements must be formed as described above, the structure of the LC filter is complicated, and miniaturization thereof is not possible.

Furthermore, in general, the resonance frequency f of an LC filter is expressed as $f=\frac{1}{2}\pi(LC)^{1/2}$, in which L represents the inductance of a resonator, and C represents the capacitance thereof. Accordingly, when a relatively high frequency LC filter is produced, the product of the capacitance C and the inductance L of the resonator must be reduced. That is, for production of a high frequency LC filter, it is necessary to reduce production errors of the resonator with respect to the inductance L and the capacitance C. Thus, for development of a higher frequency LC filter, the accuracies of many conductor patterns and via-holes must be enhanced. Thus, the development of conventional high frequency LC filters is very limited.

SUMMARY OF THE INVENTION

To overcome the above-described problems with the prior art, preferred embodiments of the present invention provide a band-pass filter of which the application at a higher frequency and the miniaturization are easily realized, and of which the conditions required for control of the dimensional accuracy are facilitated.

According to preferred embodiment of the present invention, a band-pass filter includes a dielectric body, a metal film provided on the surface of the dielectric body or inside of the dielectric body, a ground electrode provided on the surface of the dielectric body or inside of the dielectric body, and opposed to the metal film via at least a portion of the layers of the dielectric body, and input-output coupling circuits coupled to first and second portions of the outer peripheral edge of the metal film, the shape and size of the metal film and the positions of the coupling points of the input-output coupling circuits being selected such that a first resonance mode of a wave being propagated in a direction that is substantially parallel to the imaginary straight line passing through the coupling points of the input-output coupling circuit, and a second resonance mode of a wave being propagated in the substantially perpendicular direction to the imaginary straight line are generated, the metal film having a protruding portion or a concavity provided thereon in the position where the resonance electric field in at least one of the resonance modes is strong, such that the first and second resonance modes are coupled to each other.

Preferably, the metal film has a substantially rectangular, substantially rhomboid, or substantially triangular shape.

Also preferably, the metal film has a substantially rectangular planar shape, and the protruding portions or concavities are provided on a pair of sides of the substantially rectangular shape.

Moreover, preferably, the metal film has a substantially rhombic planar shape, and the protruding portion or the concavity is provided on one end side of one of the diagonal lines of the substantially rhombic shape.

The features, characteristics, elements and advantages of the present invention will be clear from the following detailed description of preferred embodiments of the invention in conjunction with the accompanying drawings.

DETAILED DESCRIPTION OF PREFERRED EMBODIMENT

Hereinafter, preferred embodiments of a band-pass filter of the present invention will be described with reference to the drawings.

In the band-pass filter of various preferred embodiments of the present invention, one metal film is provided on a dielectric body or inside of the dielectric body. Input-output coupling circuits are provided in first and second portions in the outer peripheral edge of the metal film. In a resonator having the above-described configuration, the resonance is determined by the shape and size of the metal film and the coupling points of the input-output coupling circuits. This will be described with reference to FIGS. 4 to 6.

Figure 4:
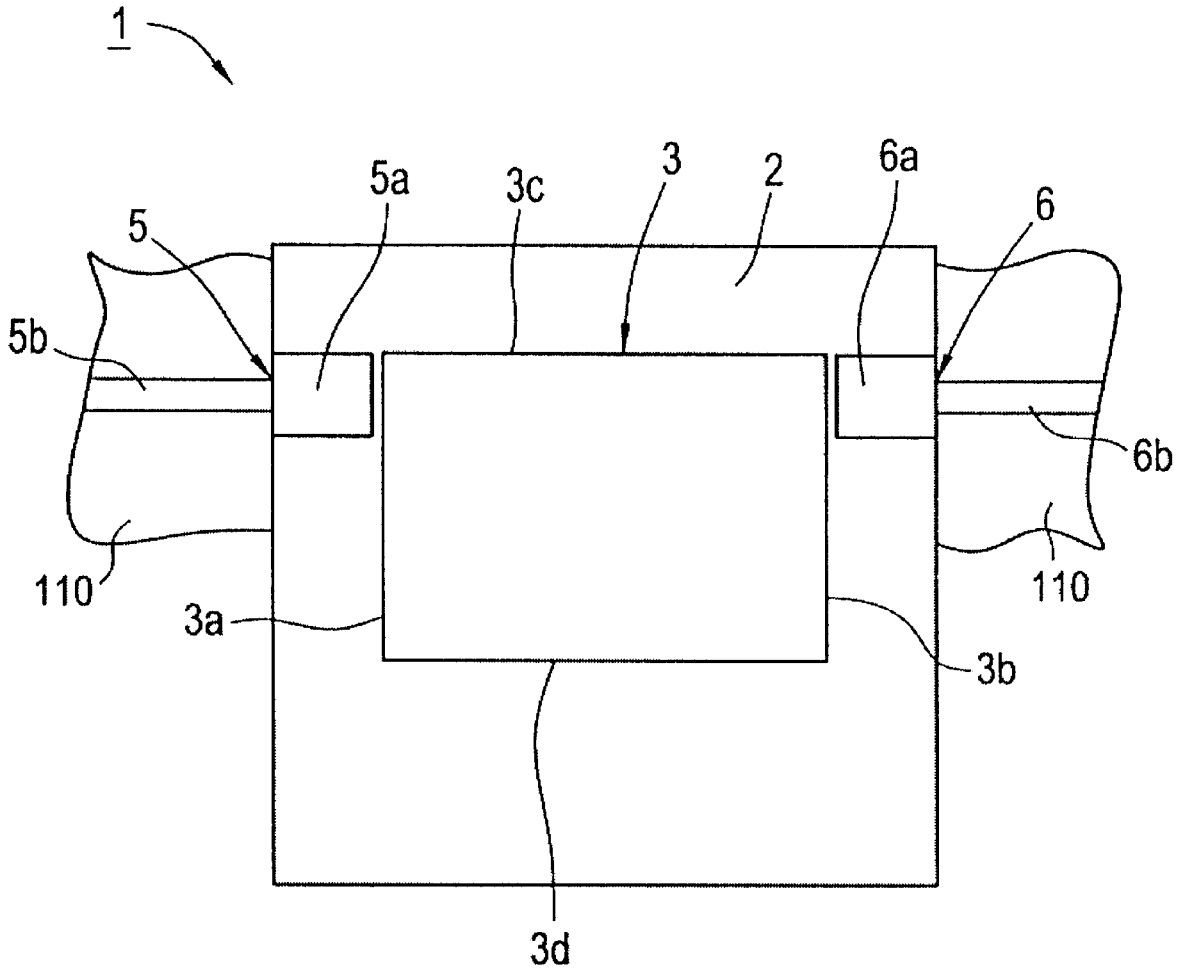
FIG. 4 is a schematic plan view of the resonator prepared for the comparison to preferred embodiments of the present invention.

As a resonator having the above-described configuration, the inventors of this application have prepared a resonator having a micro-strip configuration shown in FIG. 4. In a resonator 1 shown in FIG. 4, a metal film 3 is provided on the upper surface of a dielectric body 2. A ground electrode is provided on the under surface of the dielectric body 2 in opposition to the metal film 3. The metal film 3 preferably has a substantially rectangular shape. Input-output coupling circuits 5 and 6 are capacitively-coupled to a pair of the short sides 3*a* and 3*b* of the metal film 3 via gaps, respectively. The input-output coupling circuits 5 and 6 contain input-output capacity forming patterns 5*a* and 6*a* provided on the upper surface of the dielectric body 2. The input-output capacity forming patterns 5*a* and 6*a* are connected to micro-strip lines 5*b* and 6*b* as external lines provided on a mounting mother substrate 110 via side-surface electrodes (not shown) provided on the side-surfaces of the dielectric body 2, respectively.

Figure 5:
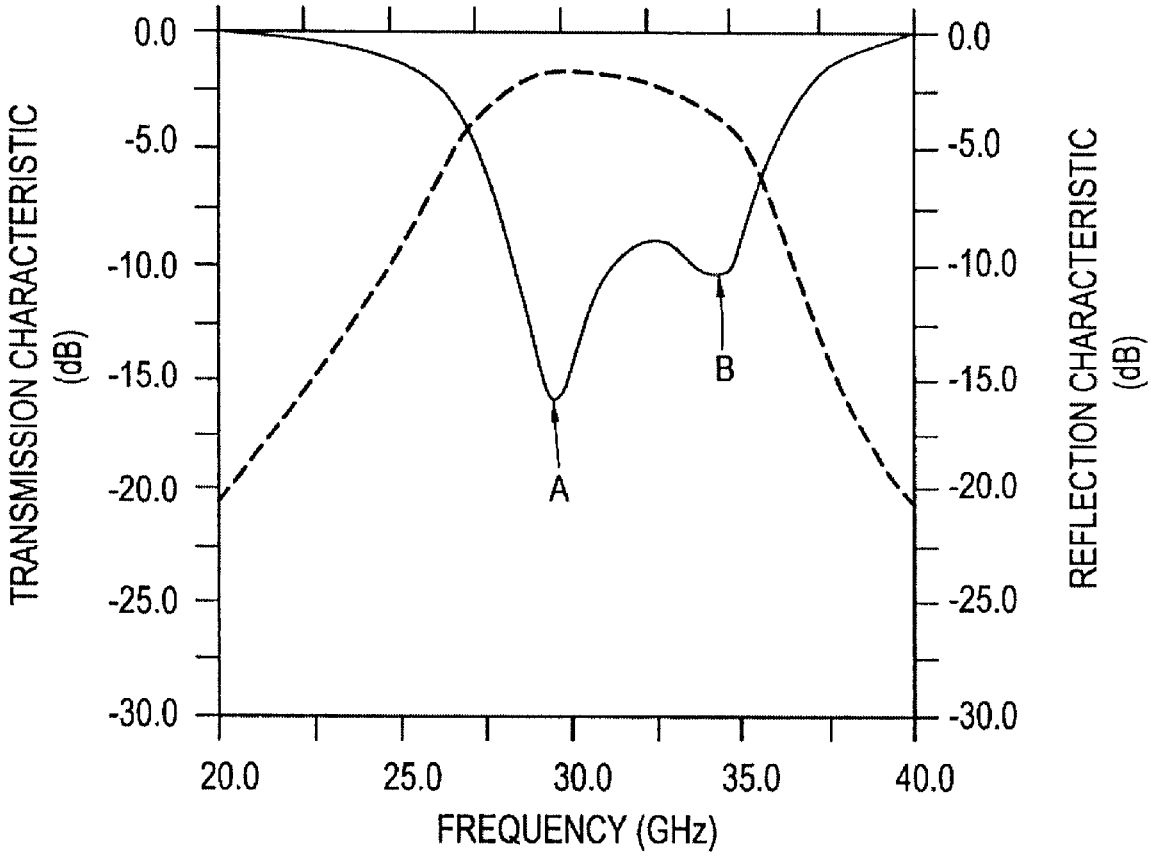
FIG. 5 is a graph showing the frequency characteristic of the resonator shown in FIG. 4.

FIG. 5 shows the frequency characteristic of the resonator 1. The solid line in FIG. 5 represents the transmission characteristic of the resonator 1, and the broken line represents the reflection characteristic thereof.

As seen in the transmission characteristic shown in FIG. 5, the resonator 1 has a first resonance point A (hereinafter, the resonance mode at the frequency is referred to as a resonance mode A) at which the resonance frequency is lowest, and a second resonance point B (hereinafter, the resonance mode at the frequency is referred to as a resonance mode B) at which the resonance frequency is the next lowest. The above-mentioned resonance modes A and B are not coupled to each other. Accordingly, the resonator does not constitute a band-pass filter.

Figure 6:
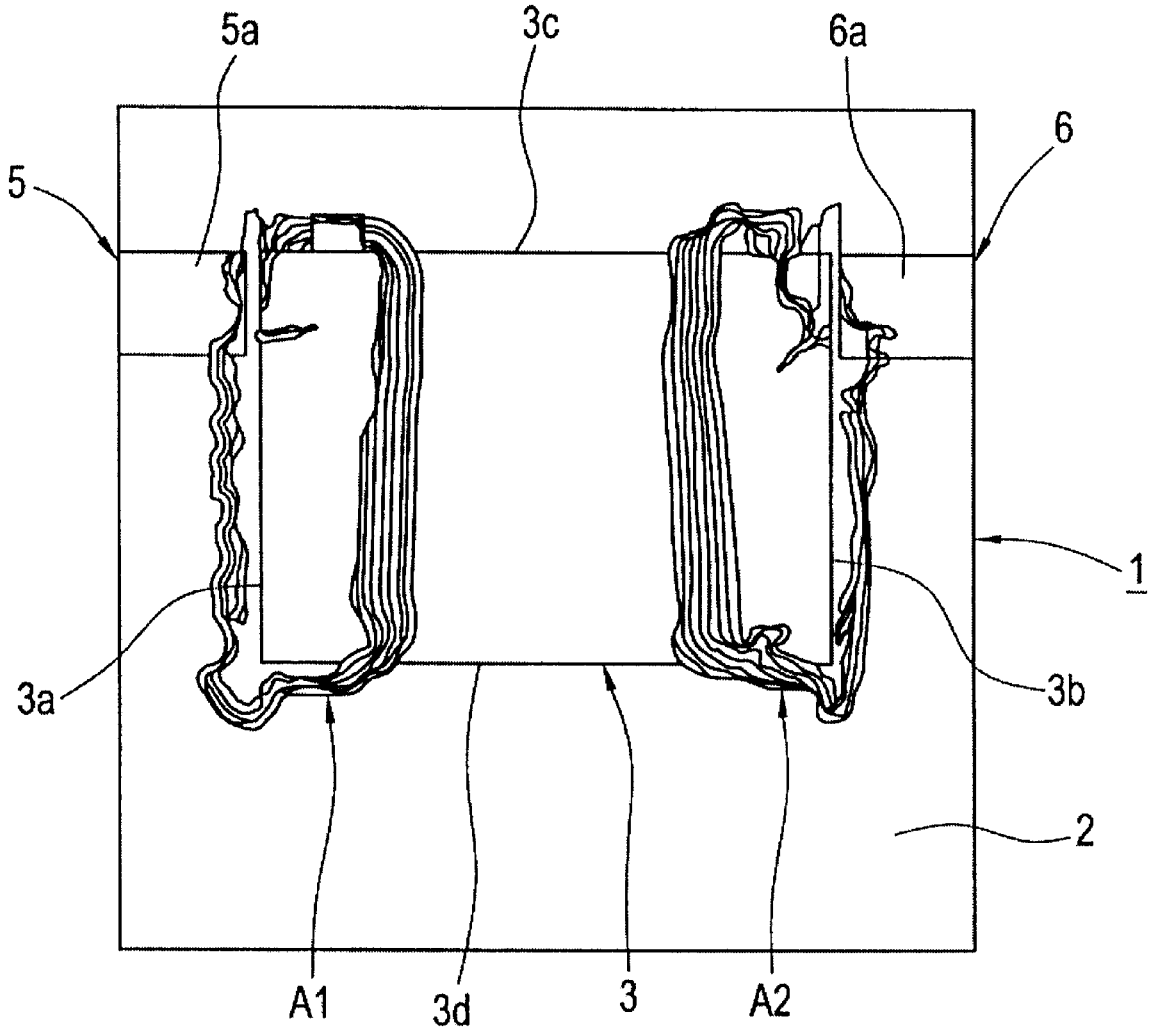
FIG. 6 is a schematic plan view illustrating the portions of the resonator shown in FIG. 4 in which strong resonance electric fields are generated at second resonation.

FIG. 6 schematically shows the portions of the resonator 1 shown in FIG. 4 in which the resonance electric fields in the resonance mode A are strong. That is, in the portions indicated by arrows A1 and A2, the resonance electric fields are strong. In other words, in the resonance mode A, the resonance electric fields are strong near a pair of the short sides 3*a* and 3*b* of the substantially rectangular metal film 3.

Furthermore, the resonance electric field distribution in the resonance mode B was investigated, though the results are not specifically shown. It was ascertained that the resonance electric fields are strong near a pair of the long sides 3*c* and 3*d* of the metal film 3.

The resonance electric field distributions, described or shown in this specification and the drawings are results obtained using of an electromagnetic field simulator HFSS produced by Hewlett-Packard Inc.

Based on the fact that the portions of the metal film where the resonance electric fields are strong in the resonance modes A and B are different from each other as described above, the inventors of this application assumed that the resonance modes A and B could be coupled to each other by control of the resonance electric field distributions in the resonance modes A and B, and thereby, a band-pass filter would be realized. On this assumption, the present invention has been devised.

Figure 1:
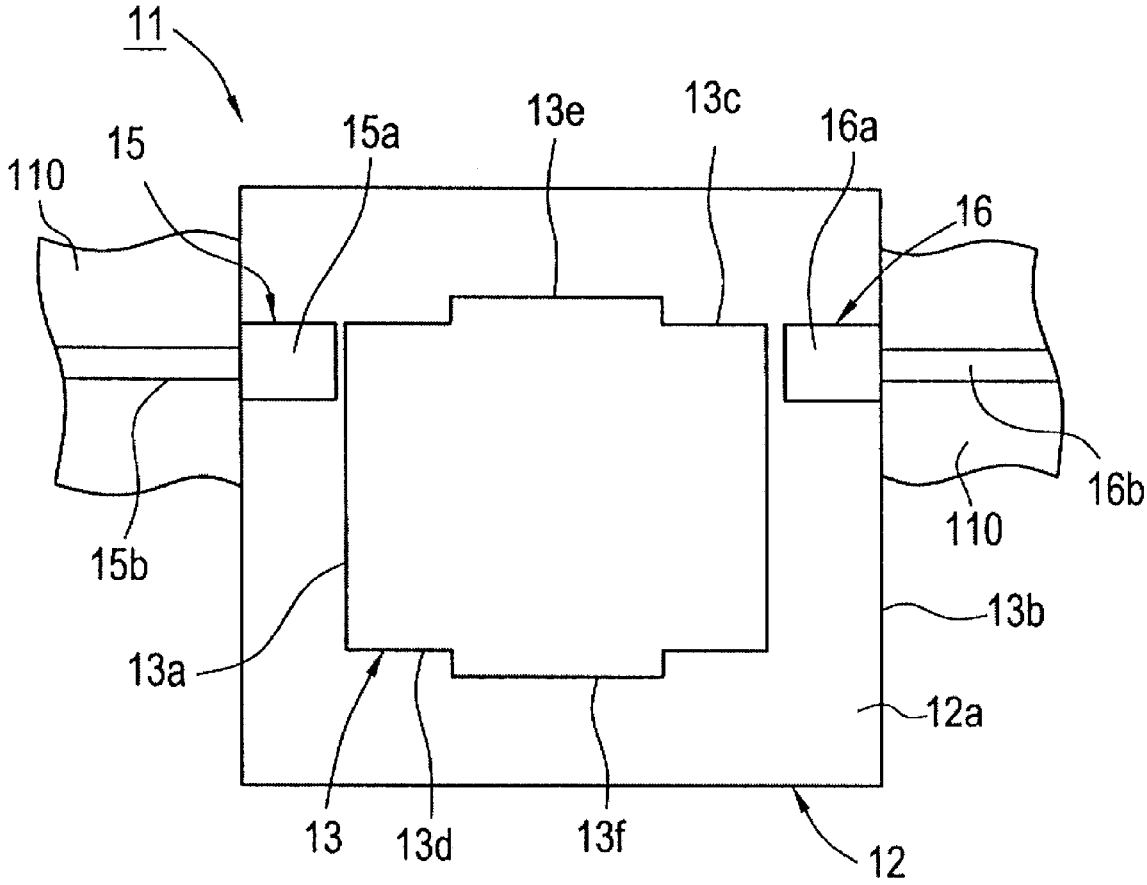
FIG. 1 is a schematic plan view of a band-pass filter according to a first preferred embodiment of the present invention.
Figure 2A:
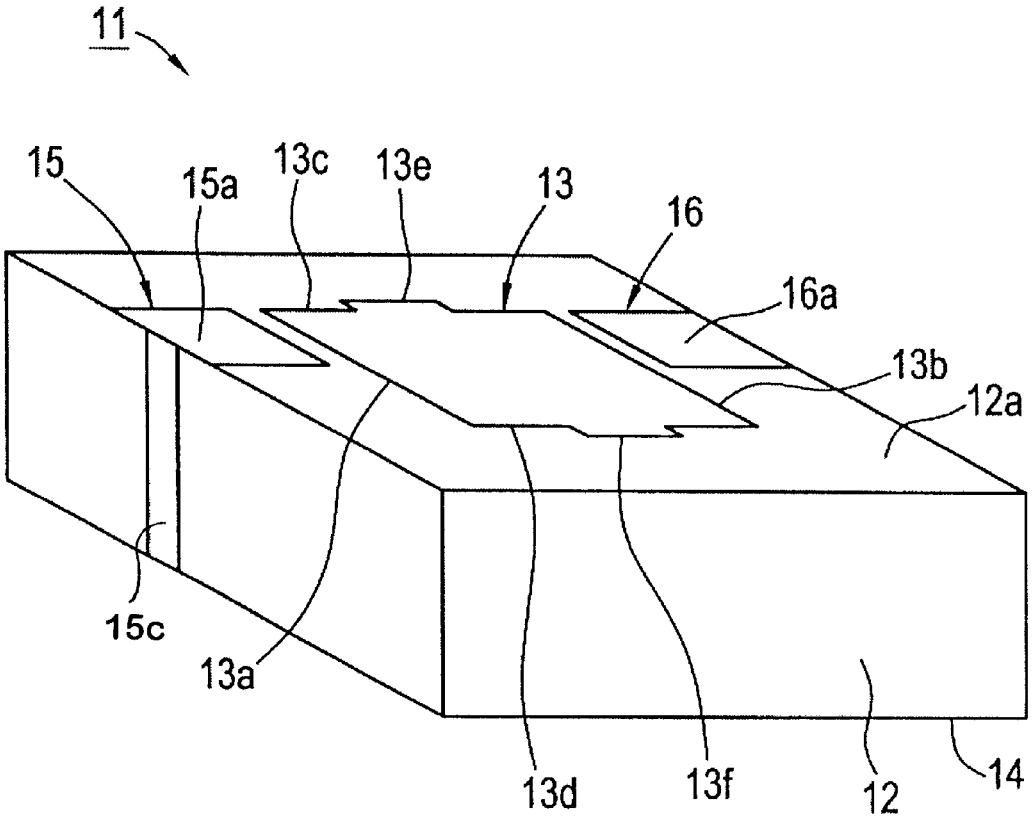
FIGS. 2(A) and 2(B) are perspective views of the band-pass filter of the first preferred embodiment.

FIG. 1 is a schematic plan view of a band-pass filter according to a first preferred embodiment of the present invention. FIG. 2(A) is a perspective view of the band-pass filter.

In a band-pass filter 11, a metal film 13 is provided on the upper surface 12*a* of a dielectric body 12, and a ground electrode 14 is provided on the lower surface 12*b*. Materials for forming the dielectric body 12 are not specifically limited. For example, appropriate synthetic resins such as fluoro-resin, epoxy resin, or other suitable synthetic resins, oxide ceramics, and so forth may be used. In this preferred embodiment, the dielectric body 12 is made of oxides of Mg, Si, and Al.

The metal film 13 and the ground electrode 14 may be made of any appropriate metal material. In this preferred embodiment, they are preferably made of Cu.

Moreover, in the metal film 13, substantially rectangular protruding portions 13*e* and 13*f* are arranged to protrude externally from a pair of the long sides 13*c* and 13*d* of the metal film 13, as is different from the example shown in FIG. 4.

The protruding portions 13*e* and 13*f* are preferably made of the same material as the metal film 13. That is, in the process of forming the metal film 13, protruding portions 13*e* and 13*f* are formed simultaneously with the metal film 13 by patterning or printing or other suitable process.

Input-output coupling circuits 15 and 16 are provided on the upper surface of the dielectric body 12 with gaps provided between the input-output coupling circuits 15 and 16 and a pair of the short sides 13*a* and 13*b* of the metal film 13, respectively. The input-output coupling circuits 15 and 16 contain capacity forming patterns 15*a* and 16*a* which are provided on the upper surface 12*a* of the dielectric body 12 with the gaps provided between the capacity forming patterns 15*a* and 16*a* and a pair of the short sides 13*a* and 13*b* of the metal film 13, respectively. The capacity forming patterns 15*a* and 16*a* are connected via side-surface electrodes 15*c* and 16*c* provided on the side surfaces of the dielectric body 12 (the side-face electrode 16*c* is not shown) to micro-strip lines 15*b* and 16*b* as external lines provided on a dielectric mother substrate 110.

In the band-pass filter 11 of this preferred embodiment, a voltage is input-output to the metal film 13 via the input-output coupling circuits 15 and 16. That is, a desired signal is transmitted to the metal film 13 via the micro-strip line 15*b* (or 16*b*), the side-surface electrodes 15*c* (or 16*c*), and the capacity-forming pattern 15*a* (or 16*a*). In this case, since the metal film 13 has a shape and size similar to that of the metal film 3 (FIG. 4), the first and second resonance modes A and B are generated. However, when the second resonance mode B is generated, a portion of the resonance electric field distributions where the resonance electric fields are strong are relaxed, due to the presence of the protruding portions 13*e* and 13*f*, such that the resonance frequency in the second resonance mode B is shifted to the low frequency side. Thus, the first and second resonance modes A and B are coupled to each other, whereby a characteristic required for the band-pass filter is obtained.

This will be described with reference to the specific experimental examples.

As the above-described dielectric body 12, a body made of an oxide ceramic containing Mg, Si, and Al as major components is used. As the metal film 13, a metal film made of Cu, having the following approximate sizes is provided. The lengths of the short sides 13*a* and 13*b* were about 1.3 mm, and the lengths of the long sides 13*c* and 13*d* were about 1.5 mm, respectively. In the protruding portions 13*e* and 13*f*, the lengths along the long sides 13*c* and 13*d* were about 1.0 mm, and the widths perpendicular to the length direction, that is, the protruding lengths were about 0.2 mm, respectively. The film thickness was about 4 $\mu$m. The capacity forming patterns 15*a* and 16*a* were provided with gaps of about 80 $\mu$m being provided between the capacity forming patterns 15*a* and 16*a* and the short sides 13*a* and 13*b*, and in opposition to the short sides 13*a* and 13*b* over the length of about 400 $\mu$m, respectively.

The ground electrode 14 was provided on substantially the entire of the lower surface of the dielectric body 12.

Figure 3:
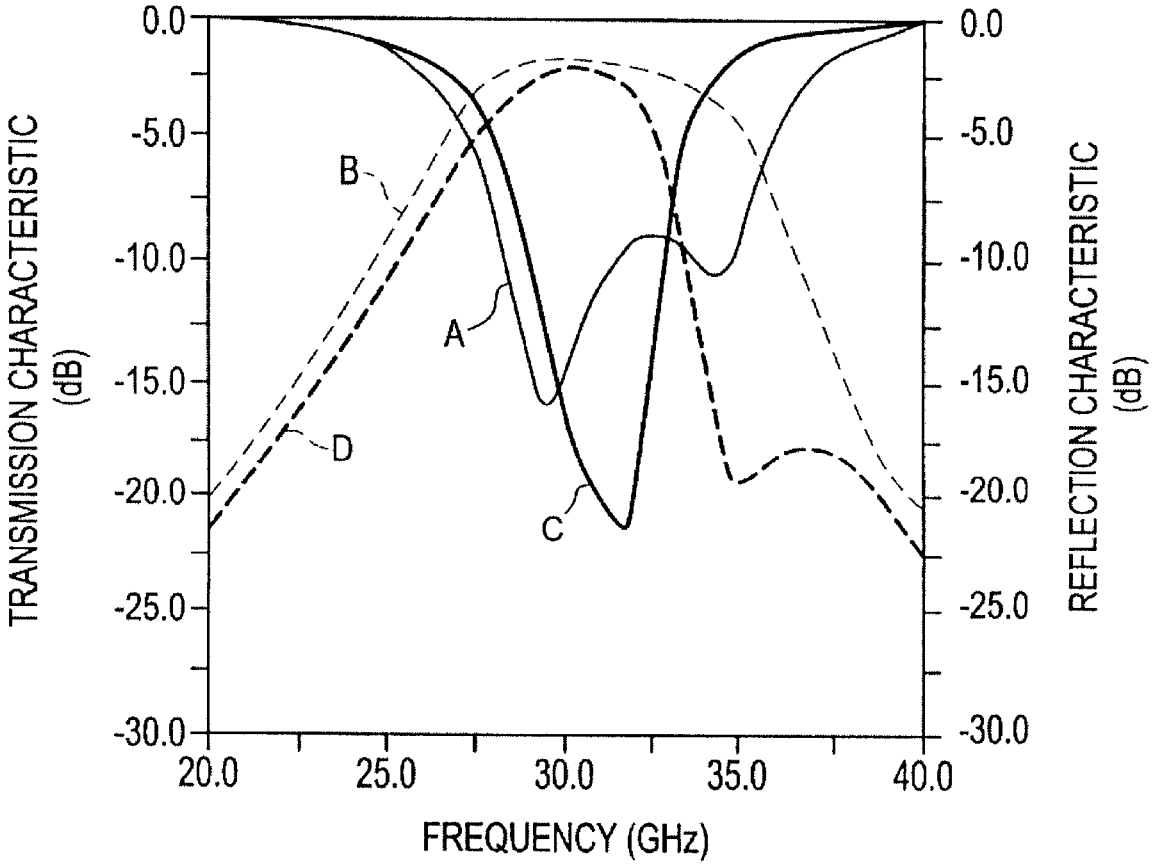
FIG. 3 is a graph showing the frequency characteristics of the first preferred embodiment and a resonator prepared for comparison thereto.

FIG. 3 shows the frequency characteristic of the band-pass filter 11.

In FIG. 3, solid line C and broken line D show the transmission and reflection characteristics of the band-pass filter 11 of this preferred embodiment, respectively. For comparison, the transmission and reflection characteristics of the resonator 1 of FIG. 6 are shown as represented by thin solid line A and thin broken line B, respectively. The resonator 1 of which the characteristics are represented by the solid line A and the broken line B is provided in the same manner as the above example except that the protruding portions 13*e* and 13*f* are not provided.

As seen in FIG. 3, in the band-pass filter 11 of this preferred embodiment, the first and second resonance modes are coupled, such that a characteristic required for the band-pass filter is obtained.

That is, the resonance electric field distributions in the second resonance mode are changed, since the protruding portions 13*e* and 13*f* are provided in the positions where the resonance electric fields in the second resonance mode are strong. As a result, the resonance frequency in the second resonance mode is shifted to the low frequency side, and is coupled to the first resonance mode. Thus, the above characteristic is obtained.

In the band-pass filter 11 of the first preferred embodiment, the formation of the protruding portions 13*e* and 13*f* causes the resonance frequency in the second resonance mode to change, such that the second resonance mode is coupled to the first resonance mode. However, according to preferred embodiments of the present invention, concavities may be provided instead of the protruding portions, such that the first and second resonance modes are coupled to each other.

Figure 7:
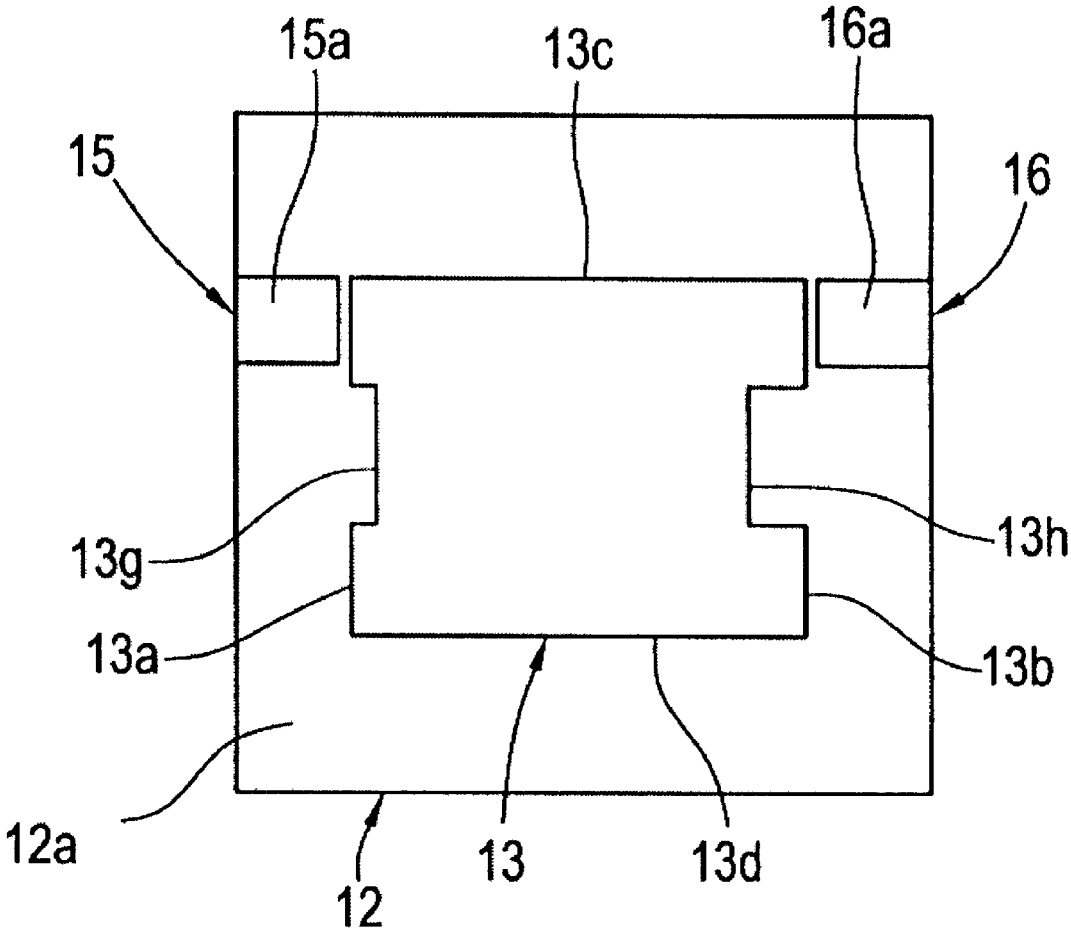
FIG. 7 is a schematic plan view of a band-pass filter as a modification of the first preferred embodiment.

FIG. 7 is a schematic plan view of the band-pass filter of the modification of the first preferred embodiment.

In the band-pass filter 18 of this modification, no protruding portions are provided on the metal film 13. Concavities 13*g* and 13*h* are provided on the short sides 13*a* and 13*b* instead of the protruding portions, respectively.

In this preferred embodiment, the concavities 13*g* and 13*h* are provided on the sides of the short sides 13*a* and 13*b*. Accordingly, the first resonance electric fields are strengthened, due to effects of the concavities 13*g* and 13*h*. Therefore, the resonance frequency in the first resonance mode is increased, so that the second and first resonance modes are coupled to each other. That is, the sizes of the concavities 13*g* and 13*h* are determined such that the first and second resonance modes are coupled to each other to obtain a characteristic required for the band-pass filter.

Figure 8:
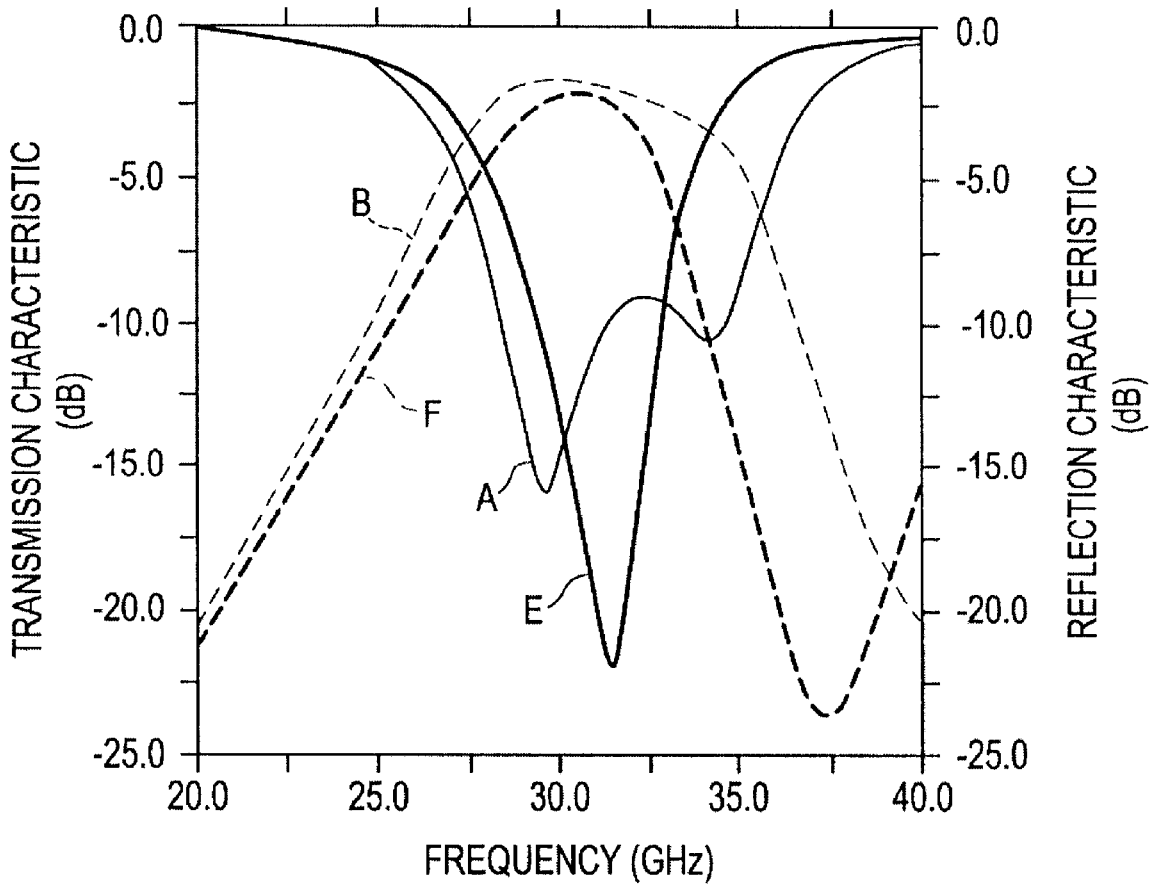
FIG. 8 is a graph showing the frequency characteristics of the band-pass filter as the modification shown in FIG. 7 and a resonator prepared for comparison.

FIG. 8 shows the frequency characteristic of the band-pass filter 18 of this modification. Solid line E and broken line F in FIG. 8 represent the transmission and reflection characteristics of the band-pass filter 18 of this modification. For comparison, the transmission and reflection characteristics of the resonator 1 of FIG. 6 are shown by solid line A and broken line B.

It is seen in FIG. 8 that in this modification, the first and second resonance modes are coupled to each other such that a characteristic required for the band-pass filter is obtained.

A protruding portion and a concavity may be provided on only one side of a pair of the opposed sides, respectively.

In the first preferred embodiment and the modification shown in FIG. 7, the substantially rectangular metal film is preferably used. In preferred embodiments of the present invention, the shape and size of the metal film is not specifically limited. The metal film may have an optional shape and size such as a rhombus, a triangle, an ellipse, or other suitable shape. In the second preferred embodiment, the metal film preferably has a substantially rhombic planar shape.

Figure 9:
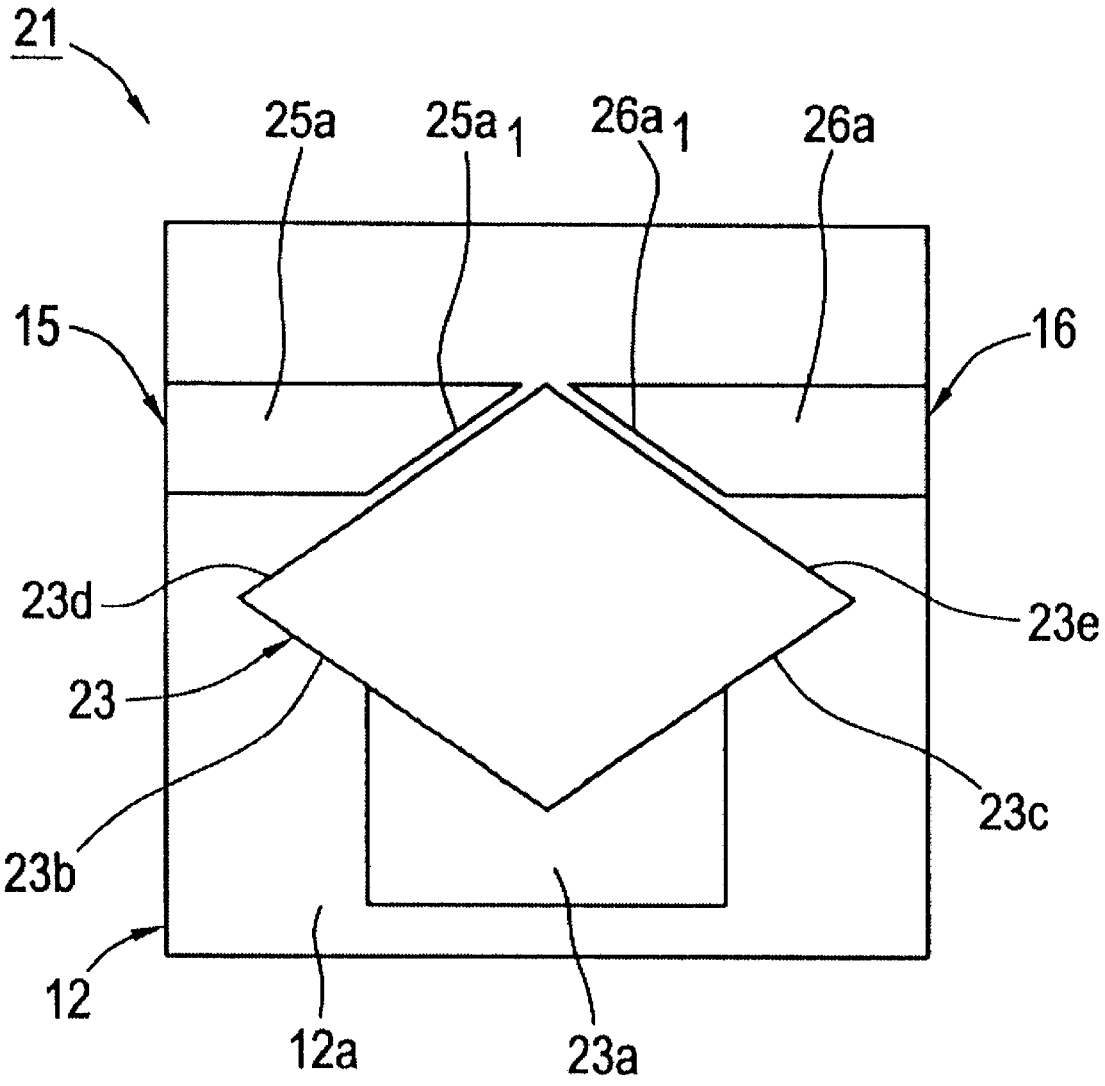
FIG. 9 is a schematic plan view of a band-pass filter according to a second preferred embodiment of the present invention.

FIG. 9 is a schematic plan view of a band-pass filter 21 according to a second preferred embodiment of the present invention. In the band-pass filter 21, a substantially rhombic metal film 23 is used. A protruding portion 23*a* is provided on one end side of the short diagonal line of the metal film 23. The protruding portion 23*a* extends from a portion of the sides 23*b* and 23*c* outward of the rhombus, covering the corner portion sandwiched between the sides 23*b* and 23*c*.

The metal film 23 and the protruding portion 23*a* are preferably made of the same metal material, and are formed simultaneously, in connection to each other by patterning, printing or other suitable method. Input-output capacity forming patterns 25*a* and 26*a* are provided near the other end side of the short diagonal line of the metal film 23. The input-output capacity forming patterns 25*a* and 26*a* have edges $\mathbf{25}a_1$ and $\mathbf{26}a_1$ elongating in a direction that is substantially parallel to the sides 23*d* and 23*e*, respectively. In the other respects, the band-pass filter 21 is configured in the same manner as the band-pass filter 11 of the first preferred embodiment. Thus, the similar components are designated by the same reference numerals, and the description is omitted.

In the second preferred embodiment, the first and second resonance modes are coupled to each other, due to the protruding portion 23*a*, such that a characteristic required for a band-pass filter is obtained. This will be described with reference to FIGS. 10 to 14.

Figure 11:
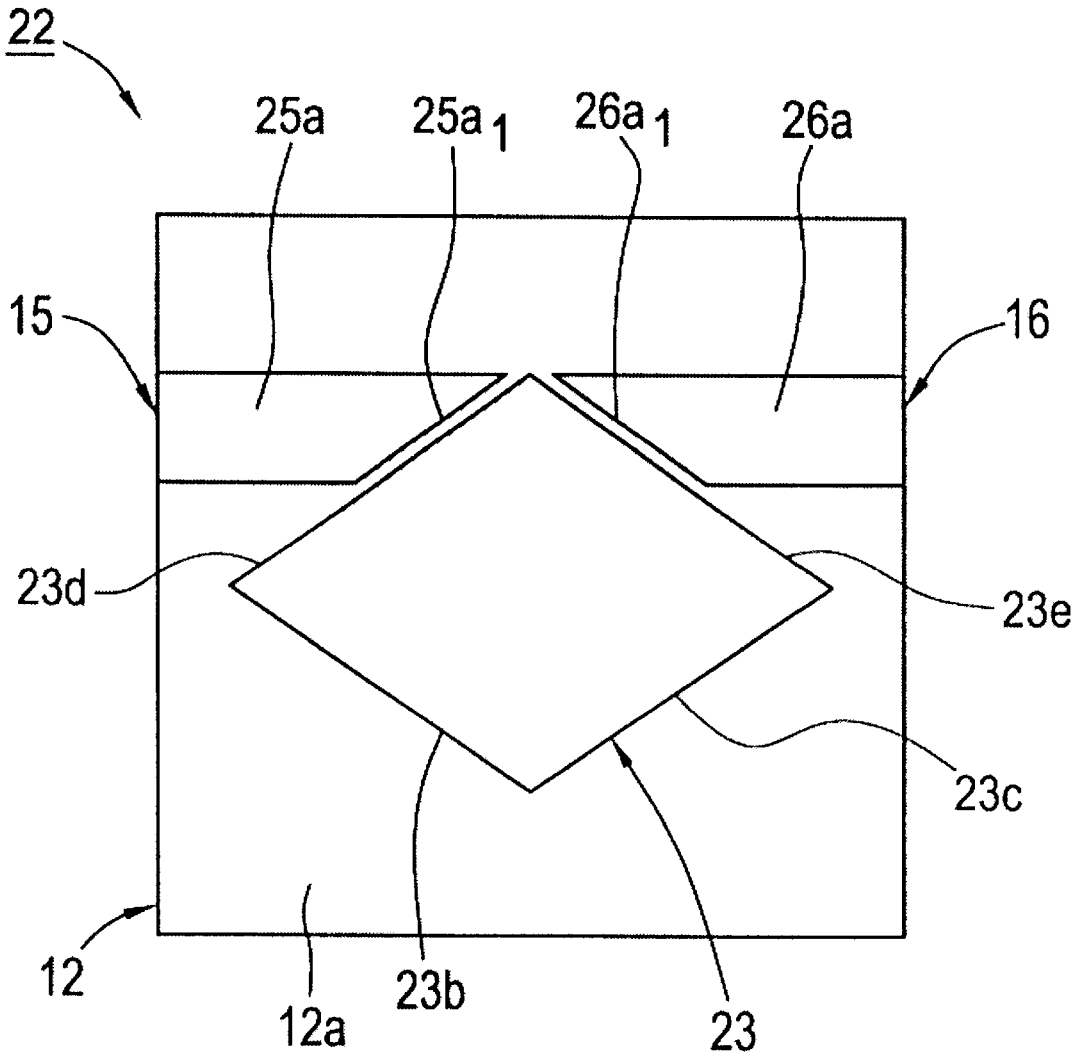
FIG. 11 is a schematic plan view of the resonator prepared for comparison with the second preferred embodiment.
Figure 12:
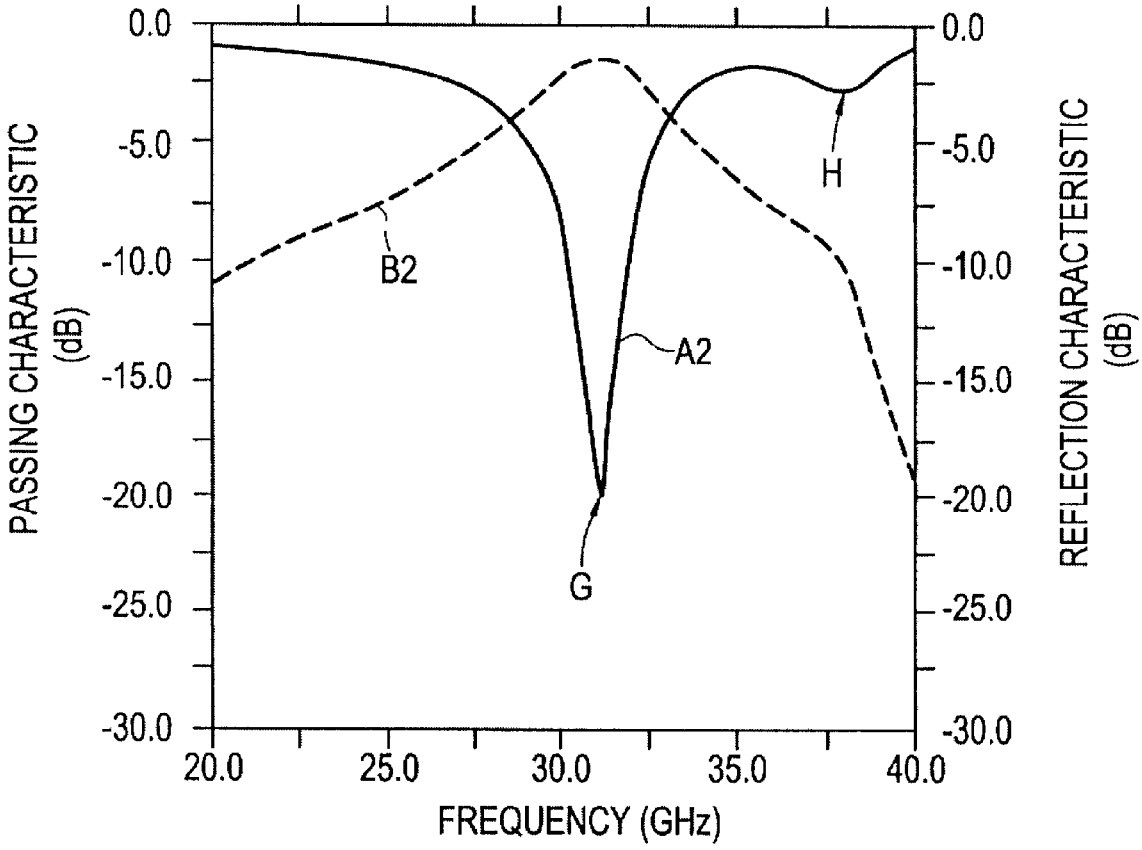
FIG. 12 is a graph showing the frequency characteristic of the resonator shown in FIG. 11.

FIG. 11 is a schematic plan view of a resonator 22 configured in the same manner as the second preferred embodiment except that the above-described protruding portion is not provided. FIG. 12 shows the frequency characteristic of the resonator 22. The dielectric body 12 is preferably a body made of a ceramic containing oxides of Mg, Si, and Al as major components similarly to the first preferred embodiment. Materials for forming the input-output capacity forming patterns, the ground electrodes, and the metal film 23 are the same as those for the first preferred embodiment. Regarding the plane shape of the metal film 23, the sizes of the short diagonal lines are preferably, for example, about 2.0 mm, and the sizes of the long diagonal lines are about 2.4 mm, respectively. Furthermore, the portions of the input-output capacity forming patterns 25*a* and 26*a*, opposed to the sides 25*d* and 25*e*, preferably have a length of about 0.4 mm, respectively. The widths of the gaps opposed to the sides 23*d* and 23*e* are about 80 $\mu$m, respectively.

FIG. 12 shows the frequency characteristic of the resonator 22. Solid line A2 represents the transmission characteristic, and broken line B2 represents the reflection characteristic. As seen in FIG. 12, a first resonance point G (hereinafter, the resonance mode at the frequency is referred to as resonance mode G), and a second resonance point H (hereinafter, the resonance mode at the frequency is referred to as resonance mode H) are present. It is seen that the first and second resonance modes G and H are not coupled to each other.

Figure 13:
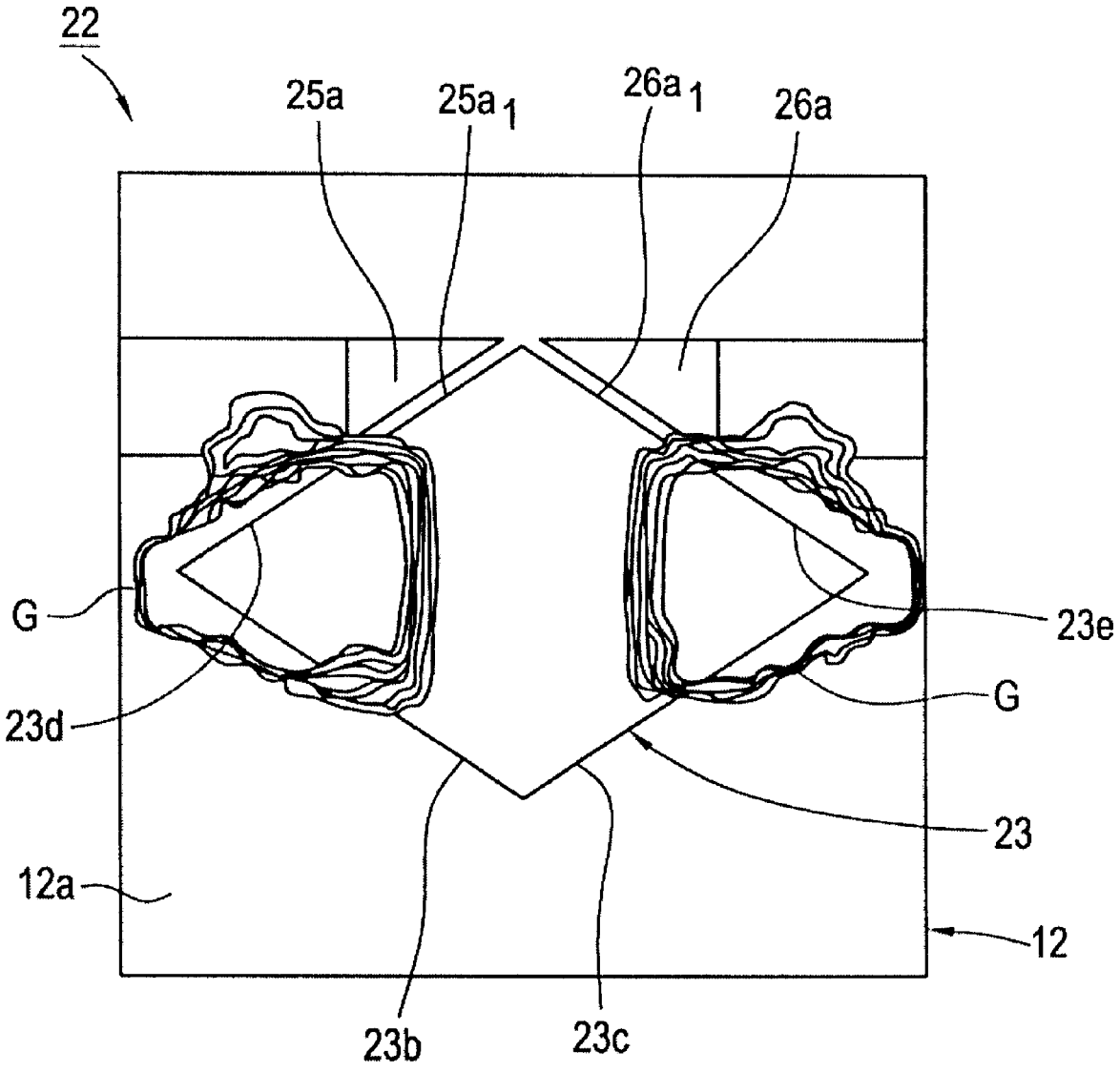
FIG. 13 is a schematic plan view illustrating the portions of the resonator shown in FIG. 11 in which strong resonance electric fields are generated at the first resonation.
Figure 14:
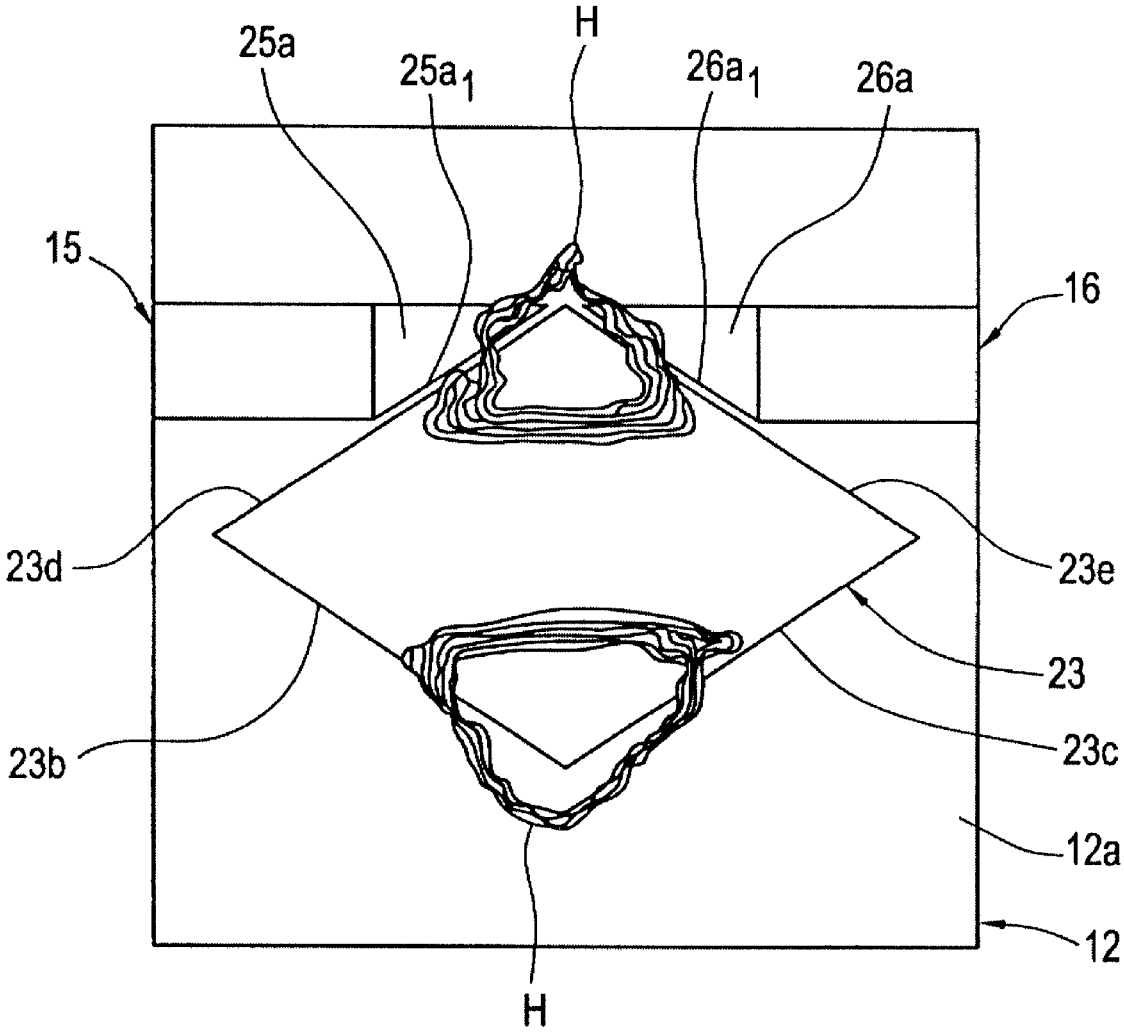
FIG. 14 is a schematic plan view illustrating the portions of the resonator shown in FIG. 11 in which strong resonance electric fields are generated at the second resonation.

The resonance electric field distributions in the first and second resonance modes G and H were investigated. In the first resonance mode G, the portions G where the resonance electric fields are strong appear on both of the ends of the long diagonal lines of the rhombus metal film 23 as shown in FIG. 13. Moreover, in the second resonance mode H, the portions H where strong electric fields are generated appear near to both of the ends of the short diagonal ones as shown in FIG. 14.

Accordingly, similarly to the first preferred embodiment, it is understood that by forming a protruding portion or a concavity on at least one-end side of the diagonal lines, the resonance electric fields of resonance on the side where the protruding portion or the concavity is provided is controlled, and the first and second resonance modes G and H are coupled to each other.

In the second preferred embodiment, the protruding portion 23*a* shown in FIG. 9 is provided on the basis of the above-described information. In particular, the protruding portion 23*a* is provided on one end side of the short diagonal lines, and acts in such a manner that the resonance electric field in the resonance mode in which a wave is propagated in the short diagonal line direction, that is, in the second resonance mode H is weakened. Accordingly, the resonance frequency in the second resonance mode H is reduced, such that the first and second resonance modes are coupled to each other. In other words, the size and width of the protruding portion 23*a* are decreased such that the protruding portion 23*a* reduces the resonance frequency of the second resonance mode G and causes the second resonance mode H to be coupled to the first resonance mode G.

Figure 10:
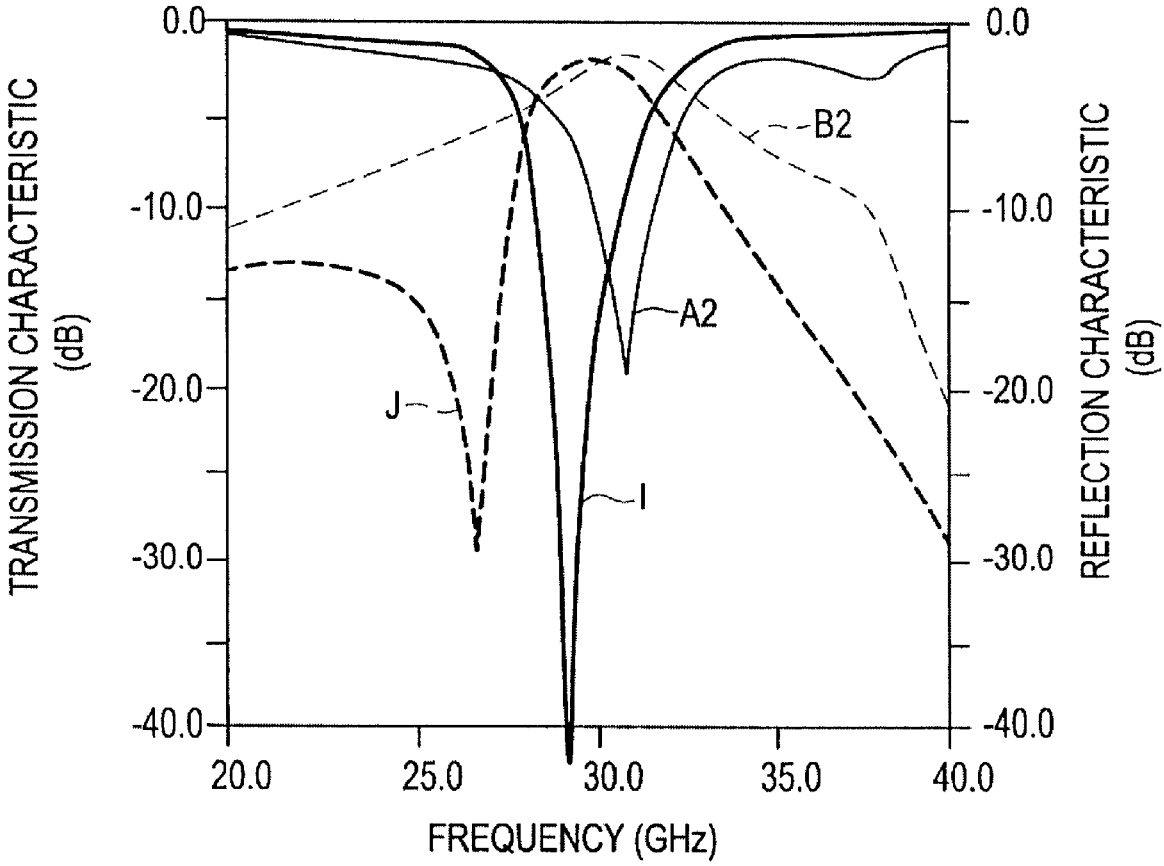
FIG. 10 is a graph showing the frequency characteristics of the band-pass filter of the second preferred embodiment and a resonator prepared for comparison.

FIG. 10 shows the frequency characteristic of the band-pass filter 21 of the second preferred embodiment. In FIG. 10, solid line I represents the transmission characteristic, and broken line J represents the reflection characteristic. For comparison, the transmission and reflection characteristics of the resonator 22 shown in FIG. 12 are shown by solid lines A2 and broken line B2 together with those of the band-pass filter 21.

As seen in FIG. 10, in the second preferred embodiment, the first and second resonance modes generated in the substantially rhombic metal film 23 are coupled to each other, such that a characteristic required for the band-pass filter is obtained.

Protruding portions may be provided on both of the ends of the short diagonal line.

In the second preferred embodiment, the protruding portion 23*a* is provided on one end side of the short diagonal line of the substantially rhombic metal film 23. Also in the second preferred embodiment, a concavity may be provided instead of the protruding portion.

Figure 15:
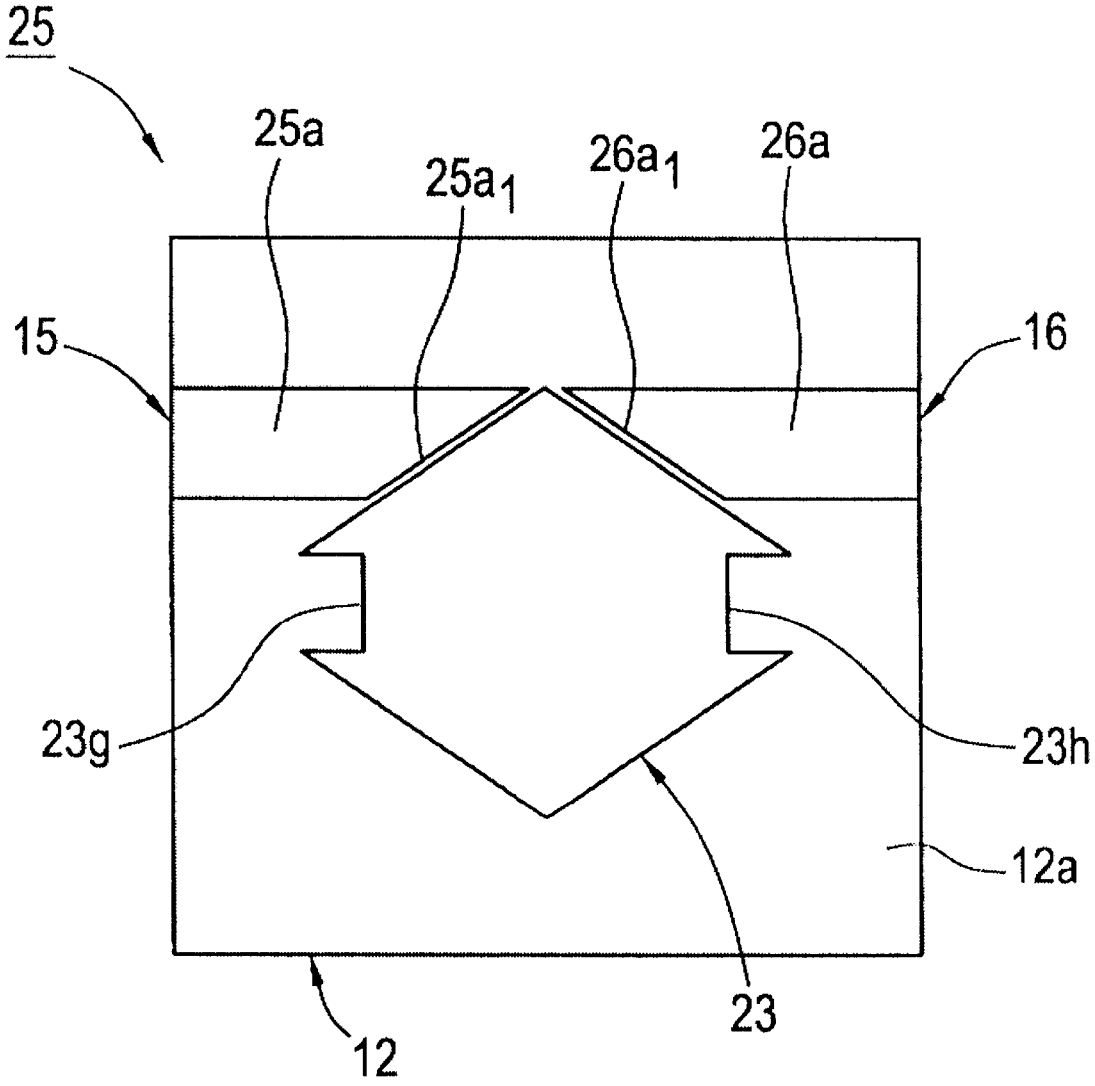
FIG. 15 is a schematic plan view of a band-pass filter according to a modification of the second preferred embodiment.

FIG. 15 shows such a modification of the second preferred embodiment as described above. In the modification, concavities 23*g* and 23*h* are provided on both of the ends of the long diagonal line of the substantially rhombic metal film 23.

A band-pass filter 25 is produced in the same manner that the second preferred embodiment except that as the concavities 23*g* and 23*h*, substantially rectangular concavities each of which the concave portion has a height of about 0.3 mm and a bottom length of about 0.6 mm are provided, and the protruding portion 23*a* is not provided.

Figure 16:
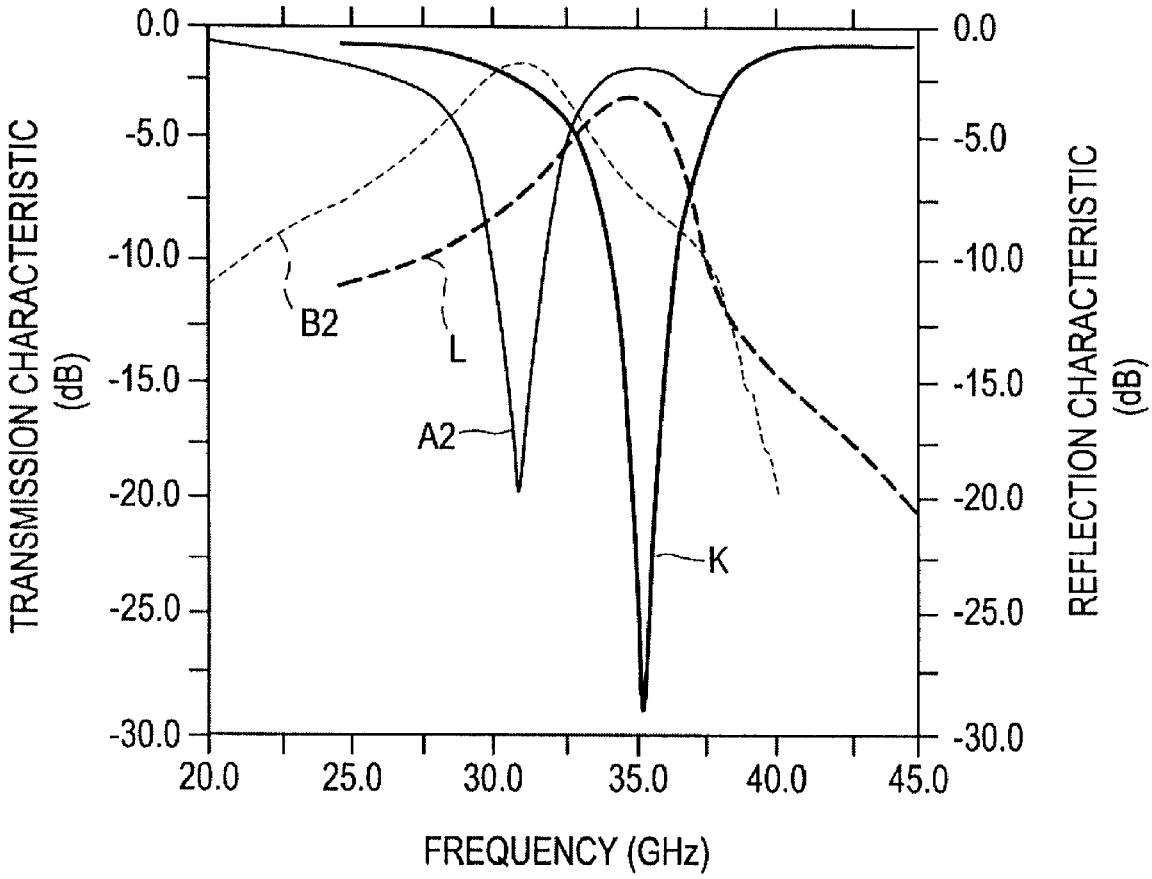
FIG. 16 is a graph showing the frequency characteristics of the band-pass filter as the modification shown in FIG. 15 and the resonator shown in FIG. 11.
Figure 17:
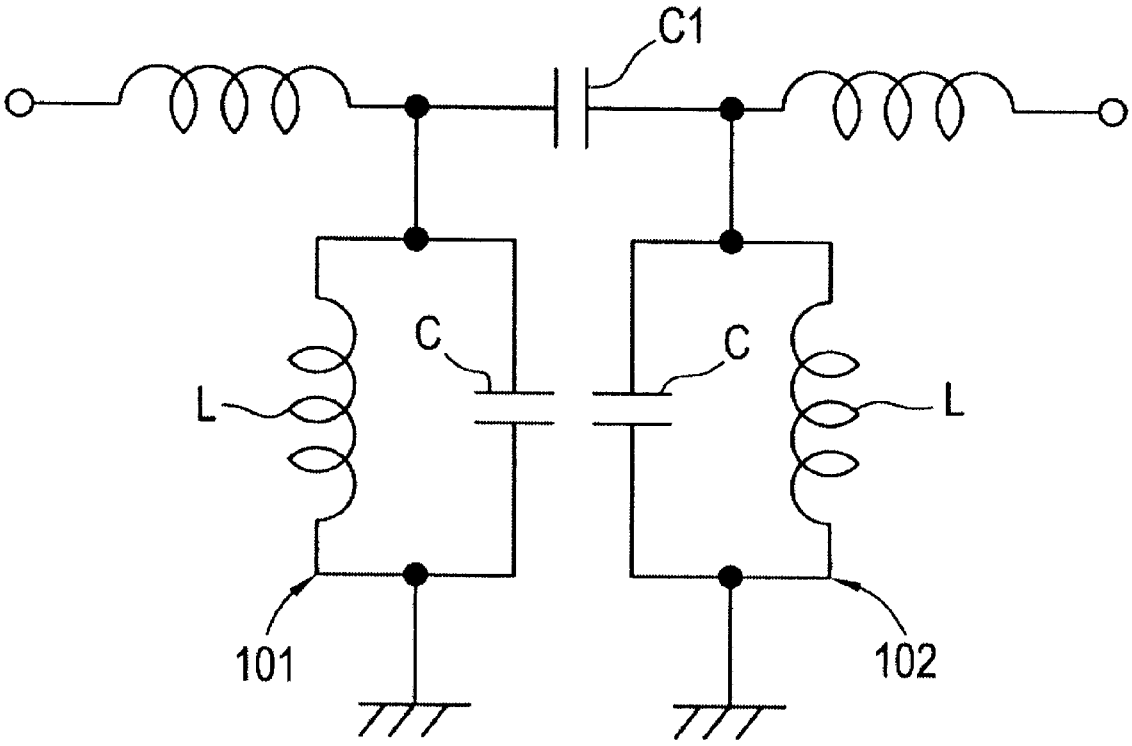
Fig.17 PRIOR ART
FIG. 17 illustrates the circuit configuration of a conventional LC filter.

FIG. 16 shows the frequency characteristic of the band-pass filter 25. In FIG. 16, solid line K represents the transmission characteristic, and broken line L represents the reflection characteristic. For comparison, the frequency characteristic (the frequency characteristic shown in FIG. 12) of the resonator 22 of FIG. 11, having no concavities and protruding portions, is shown together with that of the band-pass filter 25, in FIG. 16.

It is understood that, also in the band-pass filter of this modification, the first and second resonance modes are coupled to each other, due to the formation of the concavities 23*g* and 23*h*, as seen in FIG. 16, such that a characteristic required for the band-pass filter is obtained.

One of the concavities 23*g* and 23*h* may be provided alone, also.

Figure 2B:
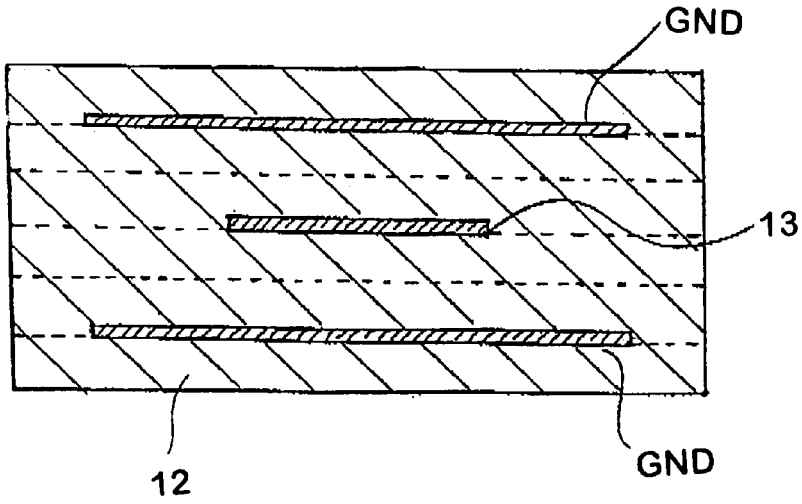

In the first and second preferred embodiments and the modifications of these preferred embodiments, the metal film is provided on the dielectric body, and the ground electrode is provided on the lower surface. However, according to other preferred embodiments of the present invention, the metal film may be provided inside of the dielectric body. Also, the ground electrode may be provided inside of the dielectric body as shown in FIG. 2(B). The formation positions of the metal film and the ground electrode are not specifically limited, provided that the metal film and the ground electrode are opposed to each other via at least a portion of the layers of the dielectric body. Desirably, the metal film and the input-output circuits are capacity-coupled to each other via a gap between them. However, strip lines or micro-strip lines as the input-output circuits may be connected directly to the metal film.

Moreover, the band-pass filter of preferred embodiments of the present invention may have an appropriate configuration such as a tri-plate configuration. Furthermore, external lines and the input-output circuits (capacity formation patterns) may be connected to each other via side surface electrodes provided on the side surfaces of the dielectric body. Moreover, they may be connected through a via-hole electrode provided inside of the dielectric body.

In the band-pass filter of preferred embodiments of the present invention, the first and second resonance modes can be coupled to each other simply by selecting the shape and size of one metal film and the coupling positions of the input-output coupling circuits, and forming the protuberant portion or concavity in the metal film. Thus, a band-pass filter having a pass-band in a desired frequency band is provided. Accordingly, the configuration of the band-pass filter which can be operated in a high frequency band can be simplified. Furthermore, when the band-pass filter is produced, the dimensional accuracy can be easily controlled. A band-pass filter usable in a high frequency band can be provided inexpensively and easily.

According to preferred embodiments of the present invention, the shape and size of the metal film is not specifically limited, and may have an optional shape such as a rectangle, a rhombus, a triangle, or other suitable shape. Thus, band-pass filters having various shapes of metal films can be formed.

When the metal film has a substantially rectangular planar shape, and the protruding portions or concavities are provided on a pair of sides of the rectangle, the input-output coupling circuits is provided on the side of a pair of the sides different from the above sides of the rectangle. Thus, the band-pass filter is easily miniaturized.

When the metal film has a substantially rhombic planar shape, and the protruding or the concavity is provided on at least one side of one diagonal line of the rhombus, the input-output coupling circuits is provided on one end side of the diagonal line which is opposite to the other end side where the protruding portion or concavity is provided. Thus, the band-pass filter is easily miniaturized.

While the invention has been described in its preferred embodiments, obviously, numerous modifications and variations of the present invention are possible in light of the above teachings. It is therefore to be understood that within the scope of the appended claims, the invention may be practiced otherwise than as specifically described.

What is claimed is:

1. A band-pass filter comprising:

a dielectric body;

a metal film provided on an outside surface of the dielectric body or inside of the dielectric body;

a ground electrode provided on the surface of the dielectric body or inside of the dielectric body, and opposed to the metal film via at least a portion of the layers of the dielectric body;

a pair of input-output coupling circuits coupled to first and second portions of an outer peripheral edge of the metal film, wherein each input-output coupling circuit has a coupling point;

the shape and size of the metal film and the positions of the coupling points of the input-output coupling circuits being selected such that a first resonance mode being propagated in a direction that is substantially parallel to an imaginary straight line passing through the coupling points of the input-output coupling circuits, and a second resonance mode being propagated in a direction that is substantially perpendicular direction to the imaginary straight line, are generated; and the metal film having a length in the direction of the first resonance mode different from a length in the direction of the second resonance mode and having a protruding portion or a concavity provided thereon in a position where the resonance electric field in at least one of the resonance modes is strong and the input-output coupling circuits are positioned such that the first and second resonance modes are coupled to each other.

2. A band-pass filter according to claim 1, wherein the metal film has a substantially rectangular planar shape.

3. A band-pass filter according to claim 2, wherein the protruding portion or concavity is provided on a pair of sides of the rectangular planar shape.

4. A band-pass filter according to claim 1, wherein the metal film has a substantially rhombus planar shape.

5. A band-pass filter according to claim 4, wherein the protruding portion or concavity is provided on at least one end side of one of the diagonal lines of the rhombus planar shape.

6. A band-pass filter according to claim 4, wherein the protruding portion or concavity is provided on two end sides of the diagonal lines of the rhombus planar shape.

7. A band-pass filter according to claim 1, wherein the metal film has a substantially triangular planar shape.

8. A band-pass filter according to 1, wherein the dielectric body is made of oxides of Mg, Si, and Al.

9. A band-pass filter according to claim 1, wherein the metal film is made of Cu.

10. A band-pass filter according to claim 1, wherein the ground electrode is made of Cu.

11. A band-pass filter comprising:

a dielectric body having at least two layers;

a metal film provided on an outside surface of the dielectric body or between said at least two layers of the dielectric body;

a ground electrode provided on the surface of the dielectric body or between said at least two layers of the dielectric body, and opposed to the metal film via at least a portion of the at least two layers of the dielectric body;

a pair of input-output coupling circuits coupled to first and second portions of an outer peripheral edge of the metal film, wherein each input-output coupling circuit has a coupling point;

the band pass filter being configured to produce a first resonance mode being propagated in a direction that is substantially parallel to an imaginary straight line passing through the coupling points of the input-output coupling circuits, and a second resonance mode being propagated in a direction that is substantially perpendicular to the imaginary straight line are generated; and the metal film having a length in the direction of the first resonance mode different from a length in the direction of the second resonance mode and having a protruding portion or a concavity provided thereon in a position where the resonance electric field in at least one of the resonance modes is strong and the input-output coupling circuits are positioned such that the first and second resonance modes are coupled to each other.

12. A band-pass filter according to claim 11, wherein the metal film has a substantially rectangular planar shape.

13. A band-pass filter according to claim 12, wherein the protruding portion or concavity is provided on a pair of sides of the rectangular planar shape.

14. A band-pass filter according to claim 11, wherein the metal film has a substantially rhombus planar shape.

15. A band-pass filter according to claim 14, wherein the protruding portion or concavity is provided on at least one end side of one of the diagonal lines of the rhombus planar shape.

16. A band-pass filter according to claim 14, wherein the protruding portion or concavity is provided on two end sides of the diagonal lines of the rhombus planar shape.

17. A band-pass filter according to claim 11, wherein the metal film has a substantially triangular planar shape.

18. A band-pass filter according to 11, wherein the dielectric body is made of oxides of Mg, Si, and Al.

19. A band-pass filter according to claim 11, wherein the metal film is made of Cu.

20. A band-pass filter according to claim 11, wherein the ground electrode is made of Cu.

* * * * *